United States Patent [19]

Okuda et al.

[11] 4,155,240

[45] May 22, 1979

[54] DRIVE SPINDLE FOR A ROLLING MILL AND APPARATUS FOR RELEASING AND CONNECTING THE DRIVE SPINDLE FROM AND TO THE ROLL OF THE ROLLING MILL

[75] Inventors: Hiroji Okuda, Nara; Masaaki Washida, Muroran, both of Japan

[73] Assignees: Nippon Steel Corporation, Tokyo; Koyo Seiko Company Limited, Osaka, both of Japan

[21] Appl. No.: 578,940

[22] Filed: May 19, 1975

[30] Foreign Application Priority Data

May 17, 1974 [JP] Japan ..... 49-55781

[51] Int. Cl.[2] ..... B21B 31/08; B21B 35/14

[52] U.S. Cl. ..... 72/239; 72/249

[58] Field of Search ..... 72/239, 238, 249

[56] References Cited

U.S. PATENT DOCUMENTS

| | | | |
|---|---|---|---|
| 2,815,690 | 12/1957 | O'Malley et al. | 72/239 |
| 3,555,871 | 1/1971 | Hlafesak | 72/239 |
| 3,559,441 | 2/1971 | Lemper et al. | 72/239 |
| 3,782,161 | 1/1974 | McGreeney et al. | 72/239 |

*Primary Examiner*—Milton S. Mehr

*Attorney, Agent, or Firm*—Mason, Fenwick & Lawrence

[57] ABSTRACT

An apparatus for selectively drivingly connecting two drive spindles to roll necks of a rolling mill includes a base frame, a movable frame slidable on said base frame, two pairs of sliding posts vertically secured on a transverse member of the movable frame, at least two pairs of holding means slidable on the pairs of sliding posts and actuated by a hydraulic actuating means respectively so as to hold yokes of the drive spindles in a position in alignment with the roll necks of the roll mill, and another hydraulic actuating means actuating the movable frame toward studs of a pinion stand or the roll necks of the roll mill.

6 Claims, 5 Drawing Figures

DRIVE SPINDLE FOR A ROLLING MILL AND APPARATUS FOR RELEASING AND CONNECTING THE DRIVE SPINDLE FROM AND TO THE ROLL OF THE ROLLING MILL

BACKGROUND OF THE INVENTION

The present invention relates to an apparatus for releasing telescopic drive spindles from roll necks of a rolling mill and connecting the same thereto, more particularly to an apparatus by which fitting yokes of telescopic drive spindles including universal joints and provided between studs of a stationary pinion stand and the roll necks of the rolling mill can be released from and connected to the roll necks of the rolling mill.

Generally, working rolls of a rolling mill are replaced with the use of a crane by which the roll is moved as suspended therefrom, or with the use of hydraulic means. In the former method, a C-shaped hook or porter bar is usually used. In recent years, a pair of upper and lower rolls are released from or connected to the drive spindles at the same time with the use of a double-eye C-shaped hook or porter bar in order to shorten the work time.

When the pair of upper and lower working rolls are handled at the same time, couplings or yokes of the upper and lower universal joints for the necks of the upper and lower rolls must be held at the same center-to-center spacing as the upper and lower rolls, whereas it is extremely difficult to maintain the upper and lower rolls at definite levels especially when a crane is used.

It is further noted that torque transmission between the coupling or yoke and the roll is effected through a joint including a key or a portion of oval rectangular cross section fitting in a bore of corresponding shape. If there is a relative angular displacement between the coupling and the roll to be jointed thereto, it is extremely difficult to eliminate such angular displacement to fit them together, because the roll neck is supported by a C-hook or porter bar and is not rotatable.

Because of these difficulties, the insertion of the roll neck into the coupling gives a high impact load to the pinion stand, permitting the roll neck to strike the coupling when the corresponding portions to be joined together differ greatly in the above-mentioned spacing or involve a rotational angular displacement.

The spindle carrier disclosed in U.S. Pat. No. 2,815,690 is for use in drive spindles having gear-type couplings of the construction shown by U.S. Pat. No. 2,136,947. The spindle carrier according to U.S. Pat. No. 2,815,690 is so constructed that coupling sleeves engaged with roll necks of a rolling mill are supported from below by cradle pads. Consequently, it is a complicated and troublesome operation on the part of an operator to support simultaneously the coupling sleeves engaged with the roll necks of the upper and lower rolls by the position adjustment of the cradle pads. This is also true of the operation of engaging the coupling sleeves with the roll necks of newly furnished rolls.

With rolling mills, the upper and lower working rolls are replaced with the upper roll placed on the lower roll in intimate contact therewith. When new upper and lower working rolls are installed on the lower backup roll, the center of the new lower working roll has been shifted from the center of the old lower working roll by an amount corresponding to ½ the difference in diameter between the new and old working rolls. The distance between the centers of the new upper and lower working rolls is greater than the distance between the old upper and lower working rolls by the sum of the difference in radius between the new and old upper working rolls and the difference in radius between the new and old lower working rolls. Generally, the upper and lower working rolls used in a pair are approximately equal in diameter. Based on the top surface of the lower backup roll, therefore, the center of the new lower working roll mounted in place has been vertically shifted from that of the old lower working roll by ½ the difference in diameter between the new and old lower working rolls. Similarly, the center of the new upper working roll has been vertically shifted from that of the old upper working roll by 3/2 times the difference in diameter between the new and old upper working rolls. The replacement of the working rolls involves such as definite relationship. However, conventional roll replacing apparatus are not provided with means for aligning new paper and lower working rolls with corresponding couplings respectively in accordance with this relationship and therefore involve great difficulties in replacing the working rolls.

BRIEF SUMMARY OF THE INVENTION

An object of the present invention is to provide an apparatus for releasing two drive spindles placed one above the other from between roll necks of a rolling mill and studs of a stationary pinion stand and connecting the spindles to the roll necks of the rolling mill, each of the drive spindles including a telescopic tube-shaped member and a fitting yoke connected to the tube-shaped member by a universal joint and releasable from and connectable to a corresponding one of the roll necks of the rolling mill by the apparatus.

Another object of the present invention is to provide an apparatus by which the yoke of the universal joint is firmly supported in its horizontal position in alignment with the roll neck of a rolling mill and moved relative to the roll neck in axial direction of the roll, so that the yoke can be released from and connected to a working roll of the rolling mill with ease and within a greatly reduced period of time for the replacement of the roll.

Another object of the present invention is to ensure the above releasing and connection procedures smoothly free of any objections such as impact due to collision between the yoke and the roll neck.

Still another object of the present invention is to provide an apparatus of the type described for the replacement of two working rolls disposed one above the other and coupled to similarly disposed two drive spindles, the apparatus being easily capable of aligning the yokes of the drive spindles with the roll necks of new upper and lower working rolls to be substituted for the old rolls in conformity with the differences in diameter between the old and new rolls.

The above object and features of the present invention will become apparent from the following descriptions of preferred embodiments taking reference to the accompanying drawings.

DESCRIPTION OF THE PREFERRED EMBODIMENTS

Figure 1:
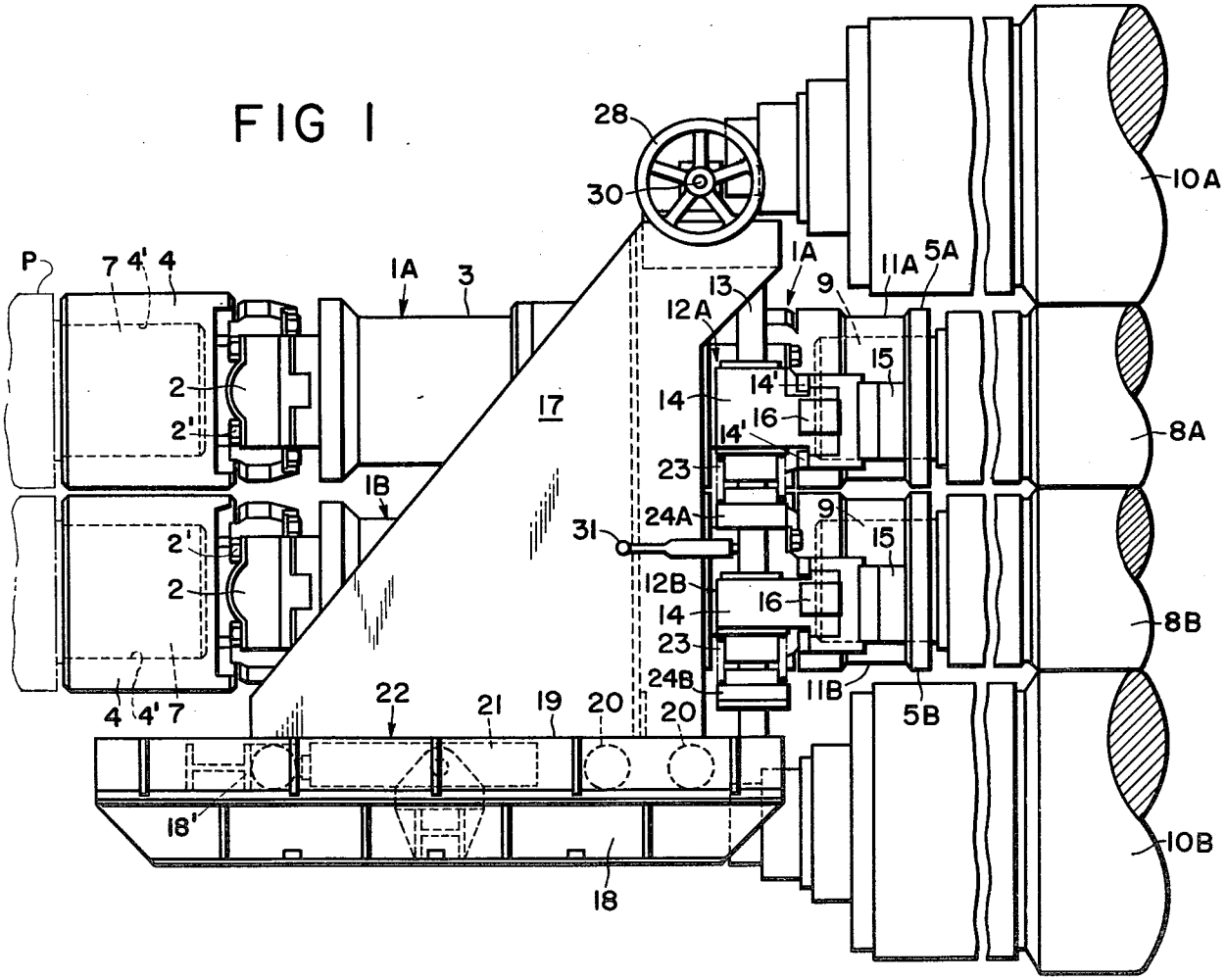
FIG. 1 is a side view of an apparatus according to the present invention.
Figure 3:
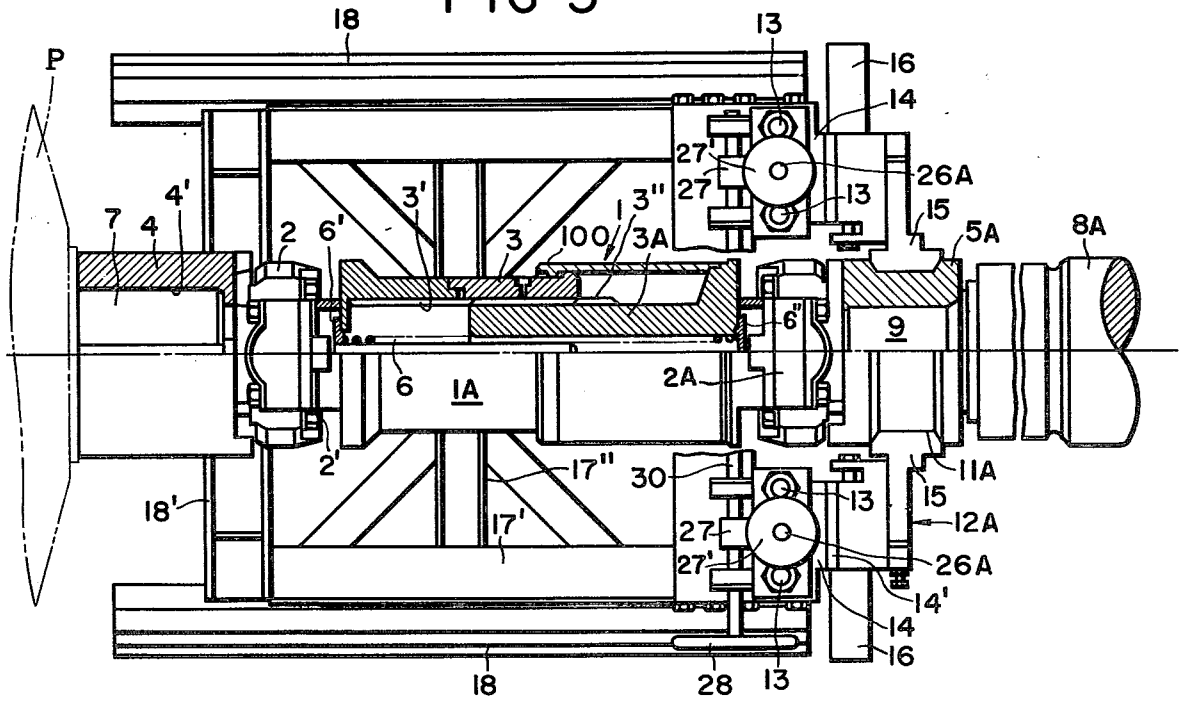
FIG. 3 is a plan view of the apparatus shown in FIG. 1 including a drive spindle.

Referring now to the drawings, and more particularly to FIGS. 1 and 3, two drive spindles 1A and 1B transmit rolling torque to milling rolls, 8A, 8B from studs 7, 7 of a pinion stand P.

Each of the drive spindles 1A and 1B consists of a fitting yoke 4 for the stud 7 having a hole 4', which is shaped oval in cross-section and engaged with the stud 7 of the pinion stand P, the stud 7 being shaped to correspond to the shape of the hole 4' of the yoke 4. The yoke 4 is secured to a universal joint assembly 2, for example of a cross pin type by means of bolts 2', which is also bolted to an end of an outer torque tube 3. The outer torque tube 3 has an internal spline 3' on the inner cylindrical surface thereof.

Referring to FIG. 3, the internal spline 3' of the outer tube 3 engages an external spline 3" provided on an end portion of an inner torque tube 3A telescopically movably positioned in the outer torque tube 3. The opposite end of inner torque tube 3A is secured or bolted to another universal joint assembly 2A which is also secured or bolted to a yoke 5 fitted to the roll neck 9 of a roll 8A of the rolling mill. The rolling mill is of the horizontal type and comprises a pair of working rolls 8A, 8B which are provided between an upper backup roll 10A and a lower backup roll 10B. Working rolls 8A and 8B are driven in opposite directions from each other by two drive spindles 1A and 1B respectively.

In the both torque tubes 3,3A a spring 6 is provided, which extends between a supporting plate 6' secured to the end of the outer torque tube 3 in the joint side and another supporting plate 6" secured to the end of the inner torque tube 3A in the joint side. Therefore, the inner and outer tubes 3,3A are urged away from each other by the spring 6.

However, a stopper means 100 is provided on the outer and/or inner tube 3,3A so as to hold the driving spindles 1 in a predetermined position, so that no thrusting load can be applied to the working rolls 8A, 8B and/or the pinion stand P.

Figure 2:
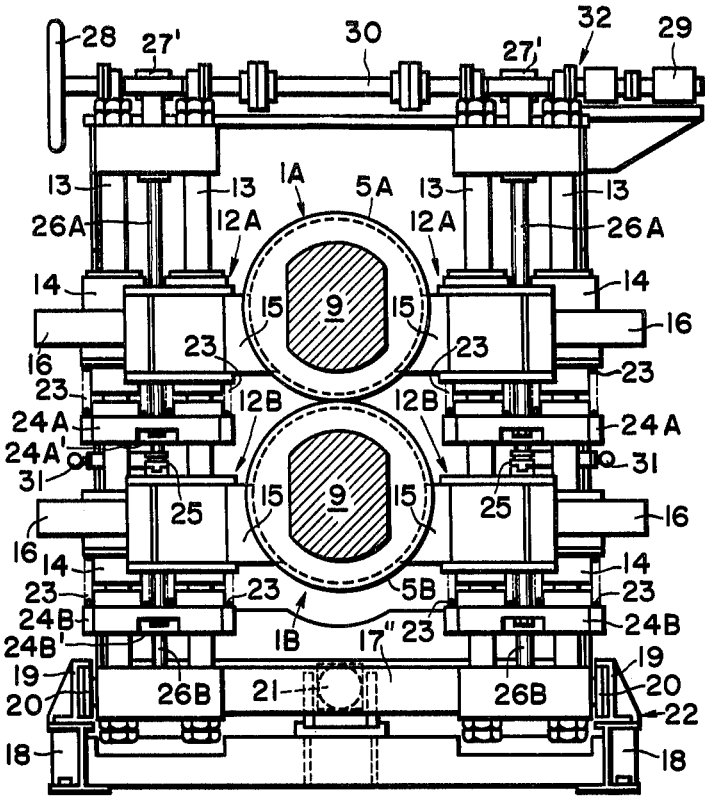
FIG. 2 is a front view of the apparatus shown in FIG. 1.

In FIGS. 1, 2 and 3 an apparatus for releasing and connecting the drive spindles 1A, 1B from and to the working rolls 8A, 8B of a rolling mill is illustrated as an embodiment. The apparatus includes a base frame 18 which can be tie-downed on the ground and on which sliding channels 19 are welded or bolted in parallel to the axis of the drive spindle, each channel 19 being positioned in a same distance to the axis of the drive spindle, namely both channels being symmetrically arranged to the plane including both axis of the drive spindles. Between the both channels 19 a movable frame 17 is provided which have a slider 20 on each longitudinal member near the sliding channel 19 respectively which can slide in the sliding channel 19 by means of an actuating means 21 of which one end is connected the transverse member 17" of the movable frame 17 and the other end to the transverse member 18' of the base frame 18.

On the transverse member 17" of the movable frame 17 in the side of the rolling mill, two pairs of the sliding posts 13 are vertically secured, each pair of the sliding posts 13 being arranged near to the sliding channel 19, so that both pairs of the sliding posts 13 are symmetrically arranged with respect to the plane including the axes of both drive spindles 1A and 1B. On each pair of the posts 13 two sliding means 14, namely an upper and a lower sliding means 14, are provided, each sliding means 14 being able to slide on the posts 13 in the vertical direction. The upper ends of the posts are rigidly secured on a transverse member of the movable frame 17 respectively.

On the other pair of the posts two sliding means 14 are arranged in the same manner as that provided on the one pair. Under each sliding means 14 a supporting member 24A, 24B are provided so as to support through springs 23, the sliding means 14, which can slide on the posts, but is positioned by a screw spindle 26A, 26B which is rotatively arranged parallel to the posts 13 and engaged with screw nuts 24A', 24B' provided beneath the supporting means 24A, 24B, so that the rotation of the screw spindle 26A, 26B varies the position of the sliding means 14. Each sliding means 14 includes a slider 14' which can carry a holding means 15 in the transverse direction to the axis of the drive spindle 1 by means of a hydraulic actuating means 16 provided between the sliding means 14 and the holding means 15 so as to hold each fitting yoke 5A, 5B of the drive spindles 1A, 1B for the rolls 8A, 8B of the rolling mill together with the other holding means means 15 carried by the sliding means 14 slidable on the other pair of the posts 13.

The both sliding means 14 and the holding means 15 are symmetrical designed each other to the plane including the axis of the drive spindles 1A and 1B, so that both holding means 15 can be hydraulically actuated toward the yokes 5A and 5B of the driving spindle 1.

The distance between the upper sliding means 14 and the lower sliding means 14 on the one pair of the posts 13 is corresponding to that between the axes of the driving spindle 1 and the same as that on the other pair of the posts.

The screw spindles 26A and 26B are provided with worm pinions 27,27'; the upper end thereof respectively, each worm pinion being engaged with a worm 27 which is mounted on a common shaft 30, so that the rotation of the shaft 30 can vary the positions of the upper and lower sliding means 14 in a common movement.

The shaft 30 is provided with a handle 28 at its one end and connected to an electric motor 29 at the other end. Under consideration of a difference of the distance between the axes of the working rolls 8A, 8B before and after exchanging the working rolls, it is preferred that the screw pitch of the screw spindle 26A for the upper supporting means 24A is three times longer than that 26B for the lower supporting means 24B, wherein the screw spindle 26A for the upper supporting means 24A is connected to that 26B for the lower supporting means 24B, by means of a coupling 25 shifted by a lever 31 so as to easily adjust the positions of the upper and lower sliding means 14 for a distance between the axes of the working rolls exchanged. Referring to the FIGS. 4 and 5, further it is preferred that the fitting yokes 5A, 5B for the rolls 8A, 8B on the periphery thereof is provided with a groove 11A or 11B in which a claw 15' formed corresponding to the groove 11A or 11B and provided on the front end of the holding means 15 it is engageable so as to securely hold the fitting yokes 5A, 5B.

Figure 4:
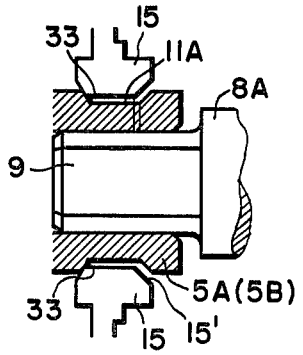
FIGS. 4 and 5 illustrate a holding means holding the yoke of the drive spindle shown in FIG. 3.
Figure 5:
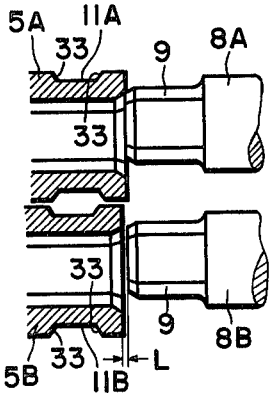

In FIGS. 4 and 5, the both side surfaces 33 of the groove 11A or 11B are taper-shaped and the claws 15' are formed corresponding to the groove, so that the distance of the claw 15' from the axis of the drive spindle 1 can vary the extending length of the drive spindle 1. The function of the apparatus according to this invention is as follows:

When releasing the drive spindles 1A and 1B from the working rolls 8A, 8B, the sliding means 14 are adjusted to the desired height by rotation of the shaft 30, the upper or lower sliding means 14 being movable independent of each other and at the same time the movable frame 17 is actuated by the hydraulic actuating means 21 so as to position the claws 15' of the holding means 15 opposite to the grooves 11A and 11B of the yokes 5A and 5B. Then the holding means 15 are actuated toward the yokes respectively by the hydraulic actuating means 16 until the holding means 15 firmly holds the yokes. Then the movable frame 17 is moved toward the pinion stand P by the hydraulic means 21, the movable frame 17 together with the holding means 15 drawing the yokes 5A and 5B from the roll necks 9 of the rolls 8A, 8B so that the axis of each yokes 5A and 5B held by the holding means 15 can be maintained horizontal because the yokes 5A and 5B are held by the holding means 15 and the springs 6 press the yoke 5A, 5B with the inner tubes 3A and the universal joint assemblies to the holding means 15. After movable frame 17 is shifted in the same length as that of the roll neck 9, the yokes 5A and 5B, namely the drive spindles 1A and 1B are released from the roll necks 9, namely the rolls 8A, 8B of the rolling mill. In case of connecting the yokes 5A, 5B to the roll necks 9 of the rolls 8A, 8B exchanged, the distance between the axes of the renewed rolls 8A, 8B is somewhat different from that between the axes of the yokes 5A and 5B held by the holding means 15.

Therefore, for example as illustrated in FIGS. 4 and 5, the upper pair of the holding means 15 are somewhat released, so that the spring 6 can move the yoke 5A a little distance toward the roll neck 9, therefore, the end surface of the yoke 5A held by the holding means 15 projects by a distance L as shown in FIG. 5 from the end surface of the other yoke 5B firmly held by the holding means 15.

The axis of the projecting yoke 5A is adjusted to the axis of the upper roll 8A, thereafter the movable frame 17 together with the holding means 15 is shifted towards and then the projecting yoke 5A reaches at the roll neck 9 of the roll 8A. Thereafter the axis of the yoke 5B is adjusted to that of the lower roll 8B, so that the both yokes 5A, 5B can be engaged with the roll necks 9 of the upper and lower working rolls 8A and 8B.

Thereafter the movable frame 17 approaches to the rolling mill at the same time the yokes 5A and 5B are engaged with the roll necks of the rolls and then the holding means 15 are fully released from the yokes.

We claim:

1. An apparatus for releasing and connecting drive spindles from and to roll necks of a rolling mill, each of the drive spindles including a yoke connected to a stud of a pinion stand, a first universal joint assembly bolted to the yoke, an outer tube bolted to the universal joint assembly, an inner tube in splined engagement with the outer tube, a second universal joint assembly bolted to the end of the inner tube, another yoke bolted to the second universal joint assembly and a spring provided in both tubes and supported between the outer ends of both tubes so as to extend both tubes outwards respectively, comprising;

a base frame, a movable frame slidable on the base frame, a hydraulic actuation means for driving the movable frame relative to the roll necks of the rolling mill in the axial direction of the roll, two pairs of sliding posts vertically secured on a transverse member of the movable frame, two pairs of sliding means disposed one pair above the other and mounted vertically slidably on the posts, two pairs of holding means being carried by the sliding means respectively and arranged on the opposite sides of the yoke of the drive spindles, each of the holding means having claws respectively for engagement with a ring-shaped groove provided on the periphery of the yoke of the second universal joint and for holding the opposite sides of the yoke to support the yoke in its horizontal position in alignment with the roll neck of the rolling mill, hydraulic actuating means provided between the sliding means and the holding means and moving a claw provided in front of the holding means relative to the ring-shaped groove of the yoke in the transverse direction to the axis of the drive spindle, supporting means supporting the sliding means through springs disposed between the supporting means and the sliding means, screw spindles rotatively arranged parallel to the sliding posts and being in screw engagement with the supporting means, each of the screw spindles comprising an upper half portion engaged with the upper supporting means, a lower half portion engaged with the lower supporting means and a shifter coupling connecting the upper and lower half portions, and means for rotating the screw spindles to move vertically the supporting means together with the sliding means and to adjust the positions of the holding means in alignment with the roll necks of the rolling mill.

2. An apparatus according to claim 1 wherein the ring-shaped grooves of the upper and lower yokes are defined by tapered side surfaces and the claws of each pair of the holding means are formed in cross sections corresponding to the grooves.

3. An apparatus according to claim 2 wherein each of the upper hald portions of the screw spindles has a three times longer screw pitch than the screw pitch of the lower half portion of the screw spindles.

4. The apparatus of claim 1 wherein said two pairs of sliding posts are respectively symmetrically positioned on opposite sides of the axes of the drive spindles.

5. The apparatus of claim 4 wherein the ring-shaped grooves of the upper and lower yokes are defined by tapered side surfaces and the claws of each pair of the holding means are formed in cross sections corresponding to the grooves.

6. The apparatus of claim 5 wherein each of the upper half portions of the screw spindles has a three times longer screw pitch than the screw pitch of the lower half portion of the screw spindles.

* * * * *